US011103039B2

(12) United States Patent
Yen et al.

(10) Patent No.: US 11,103,039 B2
(45) Date of Patent: Aug. 31, 2021

(54) PROTECTIVE CASE

(71) Applicant: ASUSTEK COMPUTER INC., Taipei (TW)

(72) Inventors: Yi-Chen Yen, Taipei (TW); Shih-Wei Chiou, Taipei (TW); Yung-Hsiang Chen, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/821,126

(22) Filed: Mar. 17, 2020

(65) Prior Publication Data

US 2020/0297089 A1 Sep. 24, 2020

(30) Foreign Application Priority Data

Mar. 20, 2019 (CN) ..... 201910211429.8

(51) Int. Cl.
*A45C 11/00* (2006.01)

(52) U.S. Cl.
CPC ..... *A45C 11/00* (2013.01); *A45C 2011/002* (2013.01); *A45C 2011/003* (2013.01); *A45C 2200/15* (2013.01)

(58) Field of Classification Search
CPC ..... A45C 11/00; A45C 2011/003; A45C 2011/001; A45C 2011/002; A45C 2200/15; B65D 5/5206
USPC ..... 206/45.2, 45.23, 45.24, 320
See application file for complete search history.

(56) References Cited

U.S. PATENT DOCUMENTS 9,013,863 B2 * 4/2015 Hsu ..... G06F 1/1654 361/679.01
2013/0126365 A1 * 5/2013 Hung ..... B65D 25/00 206/45.24
2014/0202899 A1 * 7/2014 Murchison ..... H05K 5/0234 206/320
2016/0128439 A1 * 5/2016 Senatori ..... G06F 1/162 206/45.2
2016/0134322 A1 * 5/2016 Lee ..... H04B 1/3877 455/575.3
2016/0366997 A1 * 12/2016 Sirichai ..... F16M 13/00
2017/0143088 A1 * 5/2017 Sirichai ..... A45C 11/00

FOREIGN PATENT DOCUMENTS

CN 201039813 Y 3/2008
CN 202443353 U 9/2012
CN 207367098 U 5/2018

* cited by examiner

*Primary Examiner* — Rafael A Ortiz
(74) *Attorney, Agent, or Firm* — Muncy, Geissler, Olds & Lowe, P.C.

(57) ABSTRACT

A protective case adapted for an electronic device is provided. The protective case includes a plurality of plates, at least one pivot module, an outer covering layer, and an inner covering layer. Each plate includes an inner surface and an outer surface, and at least one recess is defined between the plates. The pivot module is disposed in the recess and is connected to the plates. The outer covering layer is bonded to the outer surface of each plate and covers the recess. The inner covering layer is bonded to the inner surface of each plate and covers the recess. A side edge of the outer surface adjacent to the recess includes a chamfer.

7 Claims, 7 Drawing Sheets

PROTECTIVE CASE

CROSS-REFERENCE TO RELATED APPLICATION

This application claims the priority benefit of Chinese Application Serial No. 201910211429.8, filed on Mar. 20, 2019. The entirety of the above-mentioned patent application is hereby incorporated by reference herein and made a part of specification.

BACKGROUND OF THE INVENTION

Field of the Invention

The disclosure relates to a protective case, and in particular, to a protective case for an electronic device.

Description of the Related Art

A tablet computer provides users with good visual experience through a large-size screen. Generally, the user need to hold and operate the tablet computer by both hands, muscle ache may occur by holding the tablet computer for a long time. Therefore, many support structures for tablet computers have been developed. For example, a protective case is often equipped with a folding structure.

However, equipping the folding structure on the protective case easily leads to appearance defects such as indentations and stripes on the surface of the protective case recess.

BRIEF SUMMARY OF THE INVENTION

The disclosure provides a protective case adapted for an electronic device. The protective case includes a plurality of plates, at least one pivot module, an outer covering layer, and an inner covering layer. Each plate includes an inner surface and an outer surface, and at least one recess is defined between the plates. The pivot module is disposed in the recess and is connected to the plates. The outer covering layer is bonded to the outer surface of each plate and covers the recess. The inner covering layer is bonded to the inner surface of each plate and covers the recess. A side edge of the outer surface adjacent to the recess includes a chamfer.

The protective case provided in the disclosure allows the electronic device to be supported in different upright states such as a longitudinal upright state or a lateral upright state through folding of the plates. In addition, because the side edge of the outer surface of the plate of the protective case includes the chamfer, the problem that the outer covering layer of the protective case is worn out during folding and results an appearance defect is alleviated.

DETAILED DESCRIPTION OF THE EMBODIMENTS

Specific implementations of the disclosure are described below in detail with reference to schematic diagrams. Advantages and features of the disclosure are clearer according to the following descriptions and the claims. It is to be noted that the diagrams are presented in a very simplified form and are not drawn to scale, and are only used for the convenience and clarity of the description of the embodiments of the disclosure.

Figure 1:
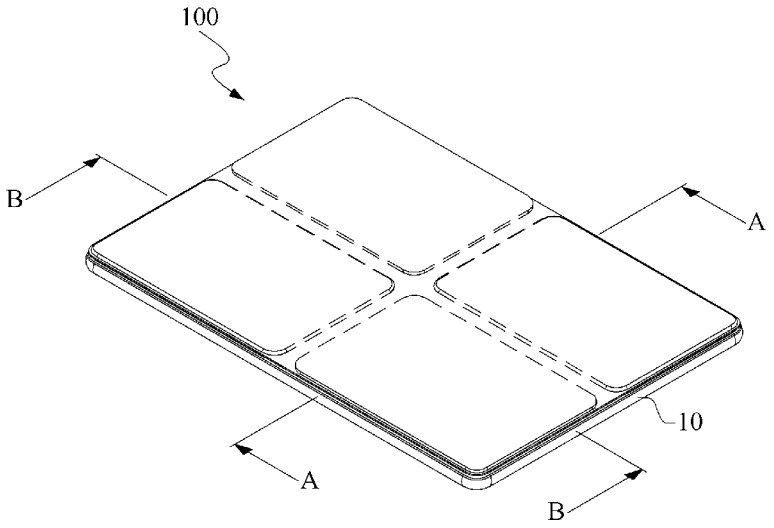
FIG. 1 is a schematic three-dimensional view of a protective case mounted on an electronic device according to an embodiment of the disclosure.
Figure 2:
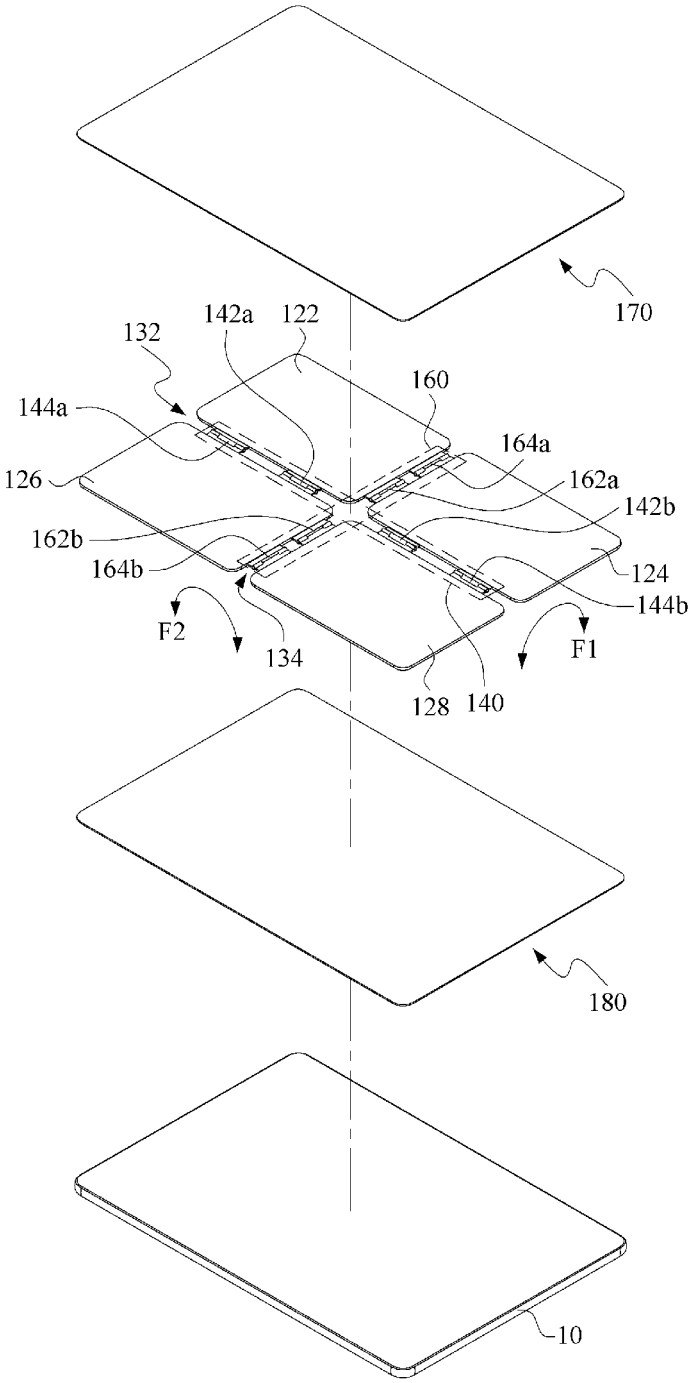
FIG. 2 is a schematic exploded view of the protective case of FIG. 1.

FIG. 1 is a schematic three-dimensional view of a protective case mounted on an electronic device according to an embodiment of the disclosure. FIG. 2 is a schematic exploded view of the protective case of FIG. 1. The protective case is adapted for the electronic device such as a tablet computer or a mobile phone, and a tablet computer is used as an example in the drawings.

As shown in the drawings, in an embodiment, the protective case 100 is mounted on a rear surface of the electronic device 10. The protective case 100 includes a plurality of plates. In this embodiment, the protective case 100 includes four plates 122, 124, 126, and 128. The protective case 100 further includes a first pivot module 140, a second pivot module 160, an outer covering layer 170, and an inner covering layer 180. The plates 122, 124, 126, and 128 are made of a rigid material to support the electronic device 10. In an embodiment, the outer covering layer 170 and the inner covering layer 180 are made of a soft or flexible material.

A first recess 132 and a second recess 134 extending in different directions are defined between the four plates 122, 124, 126, and 128. The first pivot module 140 is disposed in the first recess 132 and is connected to the plates 122, 124, 126, and 128, to define a first folding direction F1. The second pivot module 160 is disposed in the second recess 134 and is connected to the plates 122, 124, 126, and 128, to define a second folding direction F2. In this way, the protective case 100 provides two different support manners for a user.

In an embodiment, the first recess 132 is perpendicular to the second recess 134, the first recess 132 is a lateral recess and the second recess 134 is a longitudinal recess. The first folding direction F1 is perpendicular to the lateral recess, and the second folding direction F2 is perpendicular to the longitudinal recess. The lateral direction in the disclosure refers to a direction parallel to a long side of a screen of the electronic device 10, and the longitudinal direction refers to a direction parallel to a short side of the screen of the electronic device 10. The protective case 100 provides a lateral support manner and a longitudinal support manner for the user.

In an embodiment, the first recess 132 or the second recess 134 defined by the plates 122, 124, 126, and 128 extends obliquely, and the first recess 132 and the second recess 134 are not perpendicular to each other.

In an embodiment, as shown in the drawings, the first pivot module 140 includes two first pivot structures 142*a* and 142*b* and two second pivot structures 144*a* and 144*b*, the first pivot structures 142*a* and 142*b* is adjacent to an intersection of the first recess 132 and the second recess 134, and the second pivot structures 144*a* and 144*b* are located on an outer side of the first pivot structures 142*a* and 142*b*. Torque of the first pivot structures 142*a* and 142*b* is greater than torque of the second pivot structures 144*a* and 144*b* to facilitate folding operations by the user.

In an embodiment, as shown in the drawings, the second pivot module 160 includes two third pivot structures 162*a* and 162*b* and two fourth pivot structures 164*a* and 164*b*, the third pivot structures 162*a* and 162*b* are adjacent to an intersection of the first recess 132 and the second recess 134, and the fourth pivot structures 164*a* and 164*b* are located on an outer side of the third pivot structures 162*a* and 162*b*. Torque of the third pivot structures 162*a* and 162*b* is greater than torque of the fourth pivot structures 164*a* and 164*b* to facilitate folding operations by the user.

In the foregoing embodiments, the first pivot module 140 includes two first pivot structures 142*a* and 142*b* and two second pivot structures 144*a* and 144*b*, and the second pivot module 160 includes two third pivot structures 162*a* and 162*b* and two fourth pivot structures 164*a* and 164*b*. However, the disclosure is not limited thereto. The numbers of the first pivot structures 142*a* and 142*b* and the second pivot structures 144*a* and 144*b* of the foregoing first pivot module 140 are adjusted according to actual conditions such as a recess length and a pivot structure size. This also applies to the second pivot module 160.

In an embodiment, the numbers of the first pivot structures 142*a* and 142*b* and the second pivot structures 144*a* and 144*b* are set to arrange in a certain density large enough so that the pivot structures are densely arranged in the first recess 132, and the numbers of the third pivot structure 162*a* and 162*b* and the fourth pivot structures 164*a* and 164*b* are large enough so that the pivot structures are densely arranged in the second recess 134.

The plates 122, 124, 126, and 128 include outer surfaces 122*a*, 124*a*, 126*a*, and 128*a* and inner surfaces 122*b*, 124*b*, 126*b*, and 128*b* respectively, and the outer covering layer 170 is bonded to the outer surfaces 122*a*, 124*a*, 126*a*, and 128*a* of the plates 122, 124, 126, and 128, and covers the first recess 132 and the second recess 134. The inner covering layer 180 is bonded to the inner surfaces 122*b*, 124*b*, 126*b*, and 128*b* of the plates 122, 124, 126, and 128, and covers the first recess 132 and the second recess 134.

In an embodiment, the outer covering layer 170 and the inner covering layer 180 are bonded by adhesion to the outer surfaces 122*a*, 124*a*, 126*a*, and 128*a* and the inner surfaces 122*b*, 124*b* 126*b*, and 128*b* of the plates 122, 124, 126, and 128 respectively.

Figure 3A:
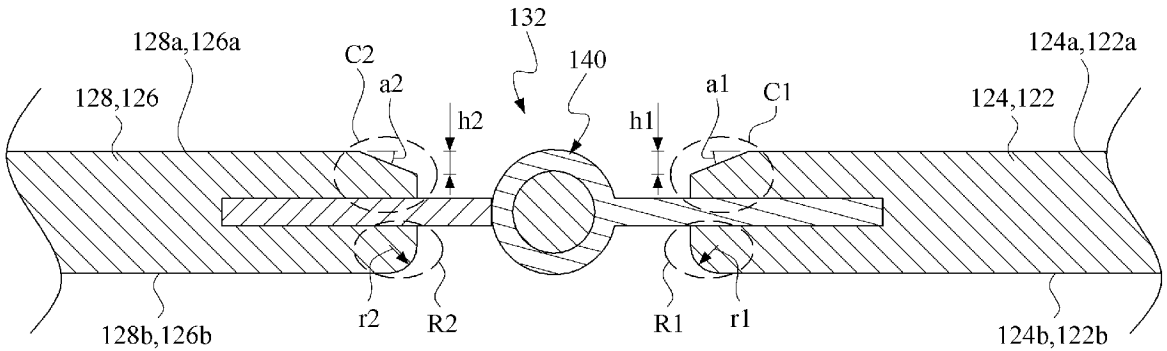
FIG. 3A is a cross-sectional view of the protective case of FIG. 1 along a line A-A.
Figure 3B:
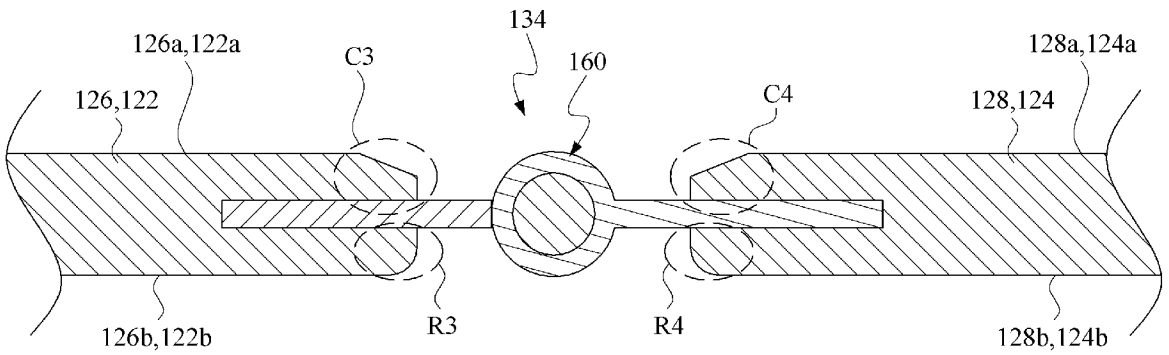
FIG. 3B is a cross-sectional view of the protective case of FIG. 1 along a line B-B.

FIG. 3A is a schematic cross-sectional view of the protective case 100 of FIG. 1 along a line A-A. FIG. 3B is a schematic cross-sectional view of the protective case 100 of FIG. 1 along a line B-B. The outer covering layer 170 and the inner covering layer 180 are not shown in the drawing for ease of illustration.

Referring to FIG. 3A, side edges of the outer surfaces 122*a*, 124*a*, 126*a*, and 128*a* of the plates 122, 124, 126, and 128 adjacent to the first recess 132 include chamfers C1 and C2, to prevent sharp edges of the plates 122, 124, 126, and 128 from scratching the outer covering layer 170 when the protective case 100 is folded along the first pivot module 140.

In an embodiment, angles a1 and a2 of the chamfers C1 and C2 are between 75 degrees and 85 degrees, and the chamfers C1 and C2 include heights h1 and h2 less than half a thickness of the first pivot module 140. The angles of the chamfers C1 and C2 are adjusted within the range depending on different materials of the outer covering layer 170.

In addition, as shown in the drawings, side edges of the inner surfaces 122*b*, 124*b*, 126*b*, and 128*b* of the plates 122, 124, 126, and 128 adjacent to the first recess 132 include rounded corners R1 and R2 to prevent the sharp edges of the plates 122, 124, 126, and 128 from scratching the inner covering layer 180. In an embodiment, radii r1 and r2 of the rounded corners R1 and R2 are between 0.5 mm and 2 mm. The radii r1 and r2 of the rounded corners R1 and R2 are adjusted within the range depending on different materials of the inner covering layer 180.

Moreover, in order to prevent the outer covering layer 170 and the inner covering layer 180 from generating a depression or bump in the first recess 132 and the second recess 134, in an embodiment, thicknesses of the first pivot module 140 and the second pivot module 160 are the same as thicknesses of the plates 122, 124, 126, and 128. In addition, because the outer covering layer 170 and the inner covering layer 180 bear different forces during use of the protective case 100, in an embodiment, the outer covering layer 170 and the inner covering layer 180 are made of different elastic materials. In an embodiment, the outer covering layer 170 is made of a material having a relatively large elastic limit to avoid non-restorable deformation.

Referring to FIG. 3B, side edges of the outer surfaces 122*a*, 124*a*, 126*a*, and 128*a* of the plates 122, 124, 126, and 128 adjacent to the second recess 134 include chamfers C3 and C4, to prevent sharp edges of the plates 122, 124, 126, and 128 from scratching the outer covering layer 170 when the protective case 100 is folded along the first pivot module 140.

In addition, as shown in the drawings, side edges of the inner surfaces 122*b*, 124*b*, 126*b*, and 128*b* of the plates 122, 124, 126, and 128 adjacent to the second recess 134 include rounded corners R3 and R4 to prevent the sharp edges of the plates 122, 124, 126, and 128 from scratching the inner covering layer 180. The chamfers C3 and C4 and the rounded corners R3 and R4 are similar to the chamfers C1 and C2 and the rounded corners R1 and R2 of FIG. 3A, and therefore will not be described in detail here.

Figure 4:
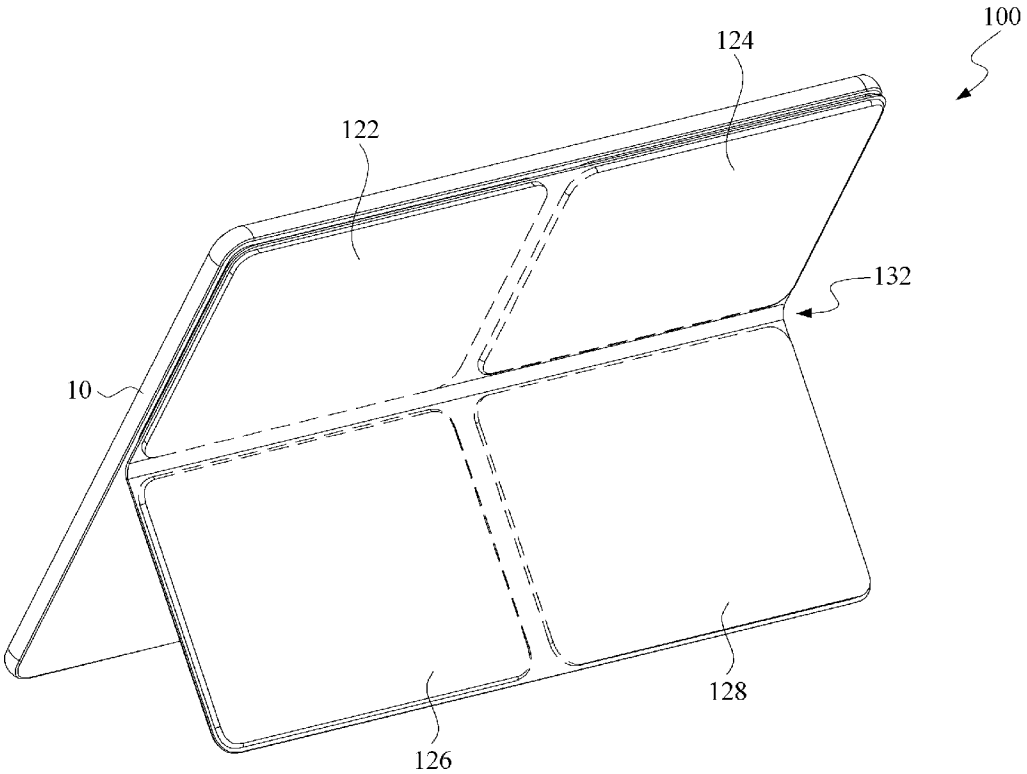
FIG. 4 is a schematic three-dimensional view of the protective case of FIG. 1 folded along a first recess to support an electronic device in a lateral upright state.
Figure 5:
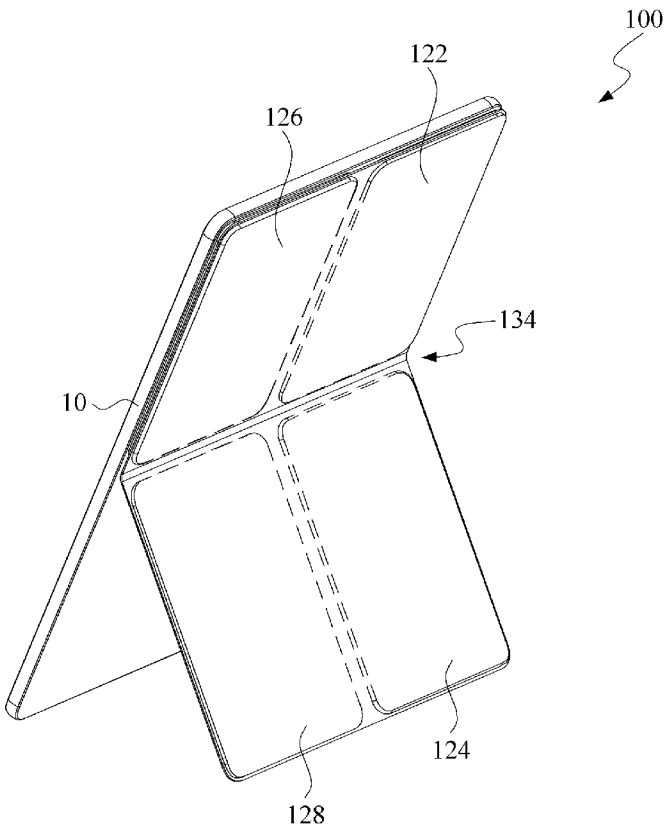
FIG. 5 is a schematic three-dimensional view of the protective case of FIG. 1 folded along a second recess to support an electronic device in a longitudinal upright state.

FIG. 4 is a schematic three-dimensional view of the protective case 100 of FIG. 1 folded along the first recess 132 to maintain the electronic device 10 in a lateral upright state. FIG. 5 is a schematic three-dimensional view of the protective case 100 of FIG. 1 folded along the second recess 134 to maintain the electronic device 10 in a longitudinal upright state.

As shown in the drawings, in the four plates 122, 124, 126, and 128, the plate 122 is fixed on the rear surface of the electronic device 10, and the other plates 124, 126, and 128 are folded to form a support structure, so as to maintain the electronic device 10 in the lateral upright state or the longitudinal upright state. Further, in the lateral upright state, the plates 126 and 128 of the protective case 100 constitute a support structure, and in the longitudinal upright state, the plates 124 and 128 of the protective case 100 constitute a support structure. Moreover, in an embodiment, the plate 122 is fixed on the rear surface of the electronic device 10 through magnetic attraction to facilitate mounting and removal by the user.

Figure 6:
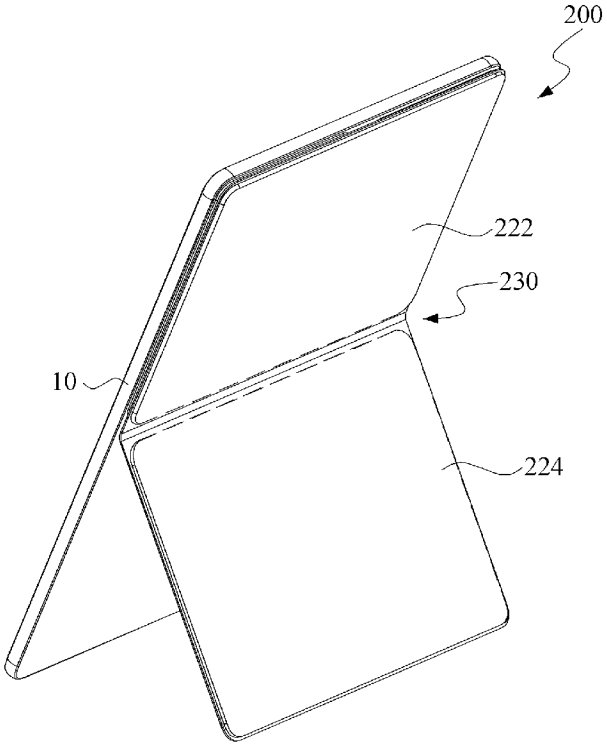
FIG. 6 is a schematic three-dimensional view of a protective case mounted on an electronic device according to another embodiment of the disclosure.

FIG. 6 is a schematic three-dimensional view of a protective case mounted on an electronic device according to another embodiment of the disclosure. In the embodiment of FIG. 1, the protective case 100 includes four plates 122, 124, 126, and 128 defining the first recess 132 and the second recess 134 extending in different directions. In contrast, the protective case 200 in this embodiment includes only two plates 222 and 224 defining a lateral recess 230, thereby reducing costs. However, the protective case 200 still maintains the electronic device 10 in the lateral upright state that is used most commonly to meet requirements of the user. Other elements in this embodiment such as a pivot module, an inner covering layer, and an outer covering layer are similar to those in the embodiment of FIG. 1, and therefore will not be described in detail here.

Compared with a conventional protective case, the protective case provided in the disclosure allows the electronic device 10 to be used in different upright states such as a longitudinal upright state and a lateral upright state through folding of the plates. In addition, because the side edge of the outer surface of the plate of the protective case includes the chamfer, the problem that the outer covering layer of the protective case is extruded by the plate during folding to cause an appearance defect is alleviated. In addition, the pivot module of the protective case includes a plurality of pivot structures having different torque, facilitating folding operations by the user.

The foregoing descriptions are merely preferred embodiments of the disclosure, and are not intended to limit the disclosure. Equivalent replacements or variations in any forms made on technical means and technical content disclosed in the disclosure, by any technical person skilled in the art without departing from the scope of the technical means of the disclosure all belong to content of the technical means of the disclosure and still fall within the protection scope of the disclosure.

What is claimed is:

1. A protective case adapted for an electronic device, comprising:

a plurality of plates, each plate comprises an inner surface and an outer surface, a recess is defined between the plates;

a pivot module, disposed in the recess and connected to the plates;

an outer covering layer, bonded to the outer surface of each of the plates and covering the recess; and an inner covering layer, bonded to the inner surface of each of the plates and covering the recess;

wherein a side edge of the outer surface adjacent to the recess comprises a chamfer, wherein a side edge of the inner surface adjacent to the recess comprises a rounded corner, wherein a lateral recess and a longitudinal recess are defined between the plates, and a first pivot module and a second pivot module are disposed in the lateral recess and the longitudinal recess respectively, wherein the first pivot module comprises a first pivot structure and a second pivot structure, the first pivot structure is adjacent to an intersection of the lateral recess and the longitudinal recess, and wherein the pivot structure is inserted or embedded within the inner surface and the outer surface of the plates.

2. The protective case according to claim 1, wherein a radius of the rounded corner is between 0.5 mm and 2 mm.

3. The protective case according to claim 1, wherein at least one of the plates is utilized to be fixed on a rear surface of the electronic device.

4. The protective case according to claim 1, wherein the second pivot module comprises a third pivot structure and a fourth pivot structure, the third pivot structure is adjacent to an intersection of the lateral recess and the longitudinal recess.

5. The protective case according to claim 1, wherein an angle of the chamfer is between 75 degrees and 85 degrees.

6. The protective case according to claim 1, wherein a height of the chamfer is less than a thickness of the pivot module.

7. The protective case according to claim 1, wherein a thickness of the pivot module is the same as a thickness of the plates.

* * * * *